US010442586B2

(12) United States Patent
Patton et al.

(10) Patent No.: US 10,442,586 B2
(45) Date of Patent: Oct. 15, 2019

(54) CHILD-RESISTANT CONTAINER

(71) Applicant: Kush Bottles, Inc., Santa Ana, CA (US)

(72) Inventors: Douglas Patton, Irvine, CA (US); Gary Bordenkircher, Lake Forest, CA (US); Jeffrey Thompson, Santa Ana, CA (US); Heather Patton, Irvine, CA (US); Mathew Astengo, Santa Ana, CA (US); Ben Wu, Santa Ana, CA (US)

(73) Assignee: KushCo Holdings, Cypress, CA (US)

( * ) Notice: Subject to any disclaimer, the term of this patent is extended or adjusted under 35 U.S.C. 154(b) by 0 days.

(21) Appl. No.: 15/997,118

(22) Filed: Jun. 4, 2018

(65) Prior Publication Data

US 2019/0144175 A1 May 16, 2019

Related U.S. Application Data

(60) Provisional application No. 62/660,764, filed on Apr. 20, 2018, provisional application No. 62/650,980, filed on Mar. 30, 2018, provisional application No. 62/586,098, filed on Nov. 14, 2017.

(51) Int. Cl.
*B65D 50/04* (2006.01)
*B65D 50/06* (2006.01)

(52) U.S. Cl.
CPC ..... *B65D 50/046* (2013.01); *B65D 50/041* (2013.01); *B65D 50/043* (2013.01); *B65D 50/061* (2013.01); *B65D 2215/02* (2013.01)

(58) Field of Classification Search
CPC .. B65D 50/046; B65D 50/041; B65D 50/043; B65D 50/061; B65D 2215/02
USPC ..... 215/44, 222, 232, 332; 220/293, 298, 220/300, 301, 304, 359.3
See application file for complete search history.

(56) References Cited

U.S. PATENT DOCUMENTS 633,297 A * 9/1899 Wanner ..... B65D 41/0428 215/329
3,485,403 A 12/1969 Hedgewick et al.
3,603,472 A * 9/1971 Lecinski, Jr. ..... B65D 41/08 215/253
3,857,507 A * 12/1974 Lecinski, Jr. ..... B65D 50/04 215/218
3,896,959 A * 7/1975 Roy ..... B65D 41/06 215/222

(Continued)

FOREIGN PATENT DOCUMENTS

EP 0517676 A1 12/1992
EP 2 537 771 3/2015

(Continued)

OTHER PUBLICATIONS

Korean Patent Office, International Search Report and Written Opinion, dated Mar. 5, 2019.

*Primary Examiner* — James N Smalley
(74) *Attorney, Agent, or Firm* — Ryan S. Dean; Umberg Zipser LLP

(57) ABSTRACT

Various embodiments of containers are described having a body with a base and sidewall that defines a hollow interior portion of the body. A separable band can be affixed to the body to provide an attachment mechanism for a cap to be coupled with the body. An insert can be disposed between the body and cap to provide a liquid-tight and air-tight seal when the cap is coupled with the body. Preferably, the insert is dual layer with a layer of foam that compresses when the cap is coupled with the body.

16 Claims, 9 Drawing Sheets

(56) References Cited

U.S. PATENT DOCUMENTS

| | | | | |
|---|---|---|---|---|
| 4,576,296 | A * | 3/1986 | Lecinski | B65D 41/08 215/274 |
| 4,818,577 | A * | 4/1989 | Ou-Yang | B32B 5/18 428/36.5 |
| 4,844,270 | A * | 7/1989 | Coffman | B29C 51/12 215/274 |
| 5,791,504 | A | 8/1998 | Hofmann et al. | |
| 9,187,220 | B2 | 11/2015 | Biesecker et al. | |
| 9,834,341 | B2 | 12/2017 | Giraud et al. | |
| 9,840,353 | B2 | 12/2017 | Dong et al. | |
| 9,889,976 | B2 | 2/2018 | Miller et al. | |
| 9,889,977 | B2 | 2/2018 | Piscopo | |
| 2004/0045967 | A1* | 3/2004 | Becker | B65D 1/0246 220/288 |
| 2006/0278642 | A1* | 12/2006 | Pugne | B65D 41/045 220/256.1 |
| 2008/0128380 | A1* | 6/2008 | Denner | B65B 7/2842 215/44 |
| 2008/0223811 | A1* | 9/2008 | Miceli | B65D 41/06 215/201 |
| 2015/0158622 | A1 | 6/2015 | Martinengo | |
| 2016/0167845 | A1 | 6/2016 | Harvey | |
| 2017/0335549 | A1 | 11/2017 | Majersky | |
| 2018/0016063 | A1 | 1/2018 | Estoque | |
| 2018/0016067 | A1 | 1/2018 | Heim et al. | |
| 2018/0044073 | A1 | 2/2018 | Dong et al. | |

FOREIGN PATENT DOCUMENTS

| | | |
|---|---|---|
| EP | 3 260 390 | 12/2017 |
| WO | 2013088422 | 6/2013 |
| WO | 2017220729 | 12/2017 |
| WO | 2018014971 | 1/2018 |
| WO | 2018031593 | 2/2018 |

* cited by examiner

CHILD-RESISTANT CONTAINER

This application claim priority to U.S. provisional application filed on Nov. 14, 2017 having Ser. No. 62/586,098. This application also claims priority to U.S. provisional application filed on Apr. 20, 2018 having Ser. No. 62/660,764. This application also claims priority to U.S. provisional application filed on Mar. 30, 2018 having Ser. No. 62/650,980. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is containers, and in particular, containers that are child-resistant.

BACKGROUND

The following description includes information that may be useful in understanding the present invention. It is not an admission that any of the information provided herein is prior art or relevant to the presently claimed invention, or that any publication specifically or implicitly referenced is prior art.

Child-resistant containers must meet certain regulatory guidelines. Traditional child resistance containers have a push down and turn style cap, where the container and cap are all made of plastic. However, such containers are not vapor and liquid-tight, and are utilitarian in design.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved child-resistance containers having a liquid and vapor-tight seal.

SUMMARY OF THE INVENTION

The inventive subject matter provides apparatus, systems and methods in which a container comprises a body having a base with at least one sidewall extending from the base. The base and at least one sidewall collectively define an interior portion of the body that has a first opening opposite of the base. In the case of a cylindrical body, a single sidewall having a circular cross-section is contemplated, whereas a square-shaped body could have four sides. Preferably, the container is composed of glass to provide a lasting, water-tight container.

A band, which could have a ring-shape, is snap-fit or otherwise coupled with an exterior surface of the at least one sidewall of the body. In this manner, the band or ring can be secured to the body and provide lugs, threads, or other fastener components that can engage with a cap that covers the first opening when coupled with the band/body.

An insert can also be provided that comprises compressible foam with a layer of Teflon or similar material disposed on one side. The insert is preferably disposed within the container such that the side with the layer of Teflon or similar material is configured to rest on top of at least one of the band and body, and preferably rests on a top surface of the at least one sidewall of the body.

When the cap engages with the band, the foam is compressed thereby pushing the layer against the band or body and sealing the interior portion via the Teflon layer or other material. Preferred containers are child-resistant, requiring a certain amount of downward force be applied to the cap during rotation to release the cap from the body/band.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
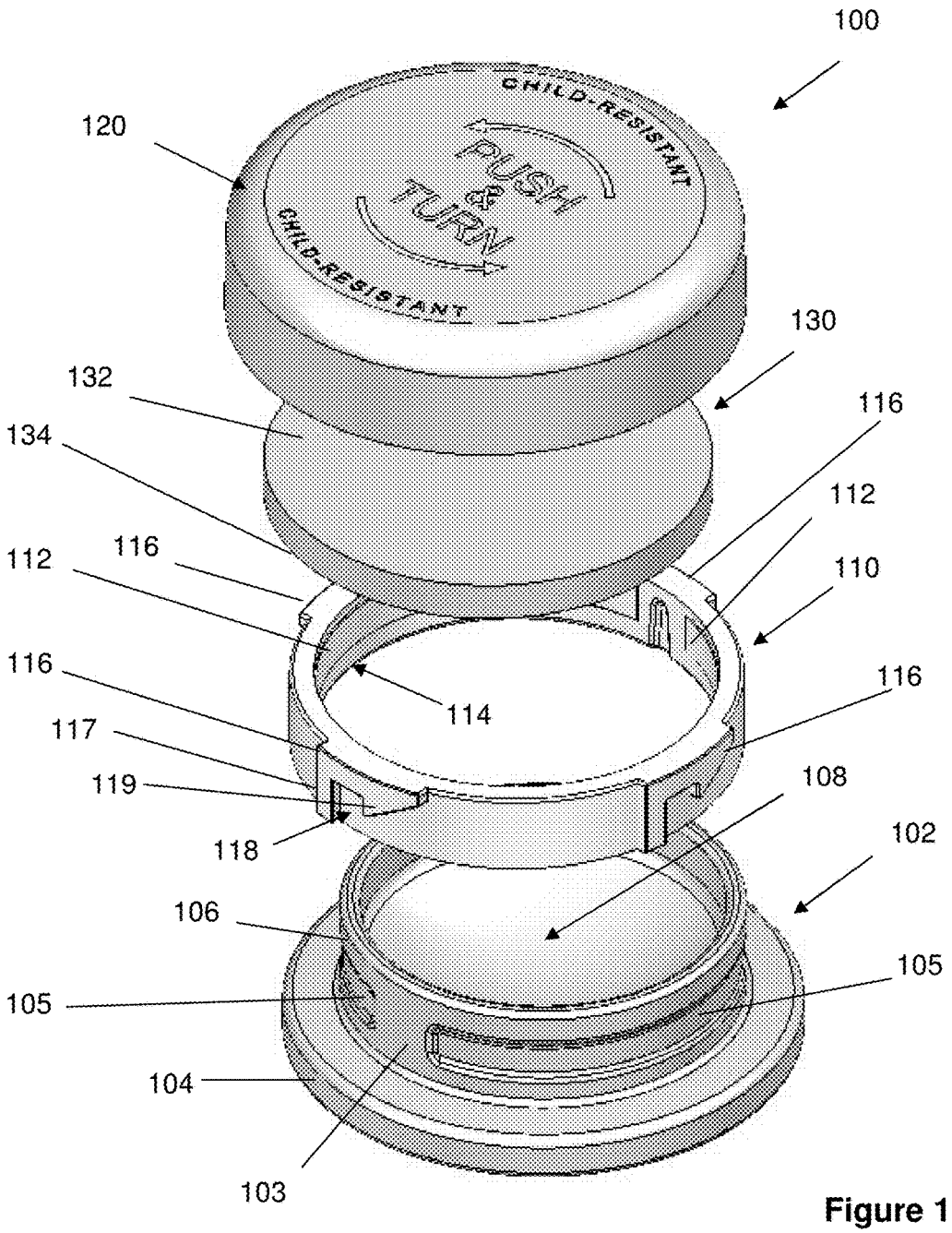
FIG. 1A illustrates an exploded view of one embodiment of a container.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1A-1D illustrates one embodiment of a container 100 comprising a body 102 having with a base 104 with at least one sidewall 106 extending from the base 104, such that the base 104 and at least one sidewall 106 define an interior portion 108 of the body 102. It is especially preferred that the body 102 is composed of glass to provide a container that can remain liquid-tight and vapor-tight for many months. Glass is also preferred because it remains liquid-tight even when highly acidic oil is stored within the interior portion 108. Glass is also unlikely to affect an odor or flavor of the contents stored within, as opposed to plastic or certain metals. However, it is contemplated that other materials could be used, especially those materials that will provide a liquid-tight and vapor-tight container that will not break down for at least six months.

In some contemplated embodiments, both the body and cap can comprise a fully biodegradable material, such as a paper or fibrous composition in which a band can be coupled such as discussed below.

The body 102 preferably has a first opening that is opposite the base 104.

A band 110 can be attached to the body 102 to provide a mechanism to which a cap 120 can be coupled to the body 102. The band 110 is preferably coupled with an exterior surface 103 of the at least one sidewall 106 of the body 102, such that the band 110 is secured in place relative to the body 102. Band 110 is preferably composed of plastic or other polycarbonate formed via an injection molding process. The use of the band 110 to engage with cap 120 advantageously provides a more precise and accurate locking than can be achieved by using glass alone.

It is especially preferred that the band 110 snap-fits onto the body 102. In the embodiment shown, sidewall 106 can include one or more indentations 105 that extends outwardly from an outer surface 103 of the at least one sidewall 106. To permit engagement of the band with the sidewall 106, the band 110 comprises one or more projections 112 on an inner surface 114 of the band 110, such that the band 110 engages the body 102 when the one or more projections 112 are inserted within one or more indentations 105. Of course, it is alternatively contemplated that the band could comprise one or more indentations that in turn mate with one or more projections of the body.

Cap 120 is configured to engage with the band 110 to thereby cover the first opening and seal the interior portion 108.

Figure 1B:
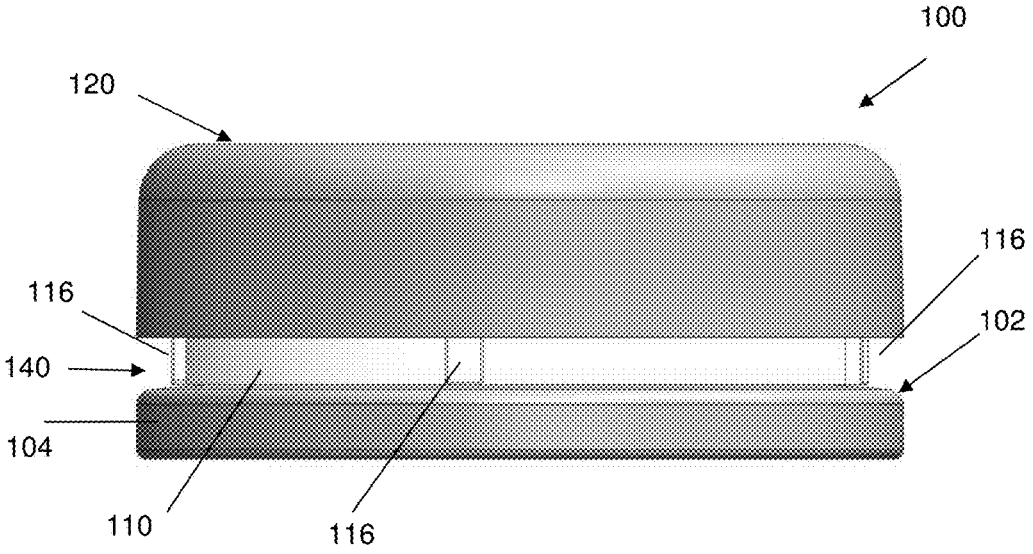
FIG. 1B illustrates a perspective view of the container of FIG. 1A.
Figure 1C:
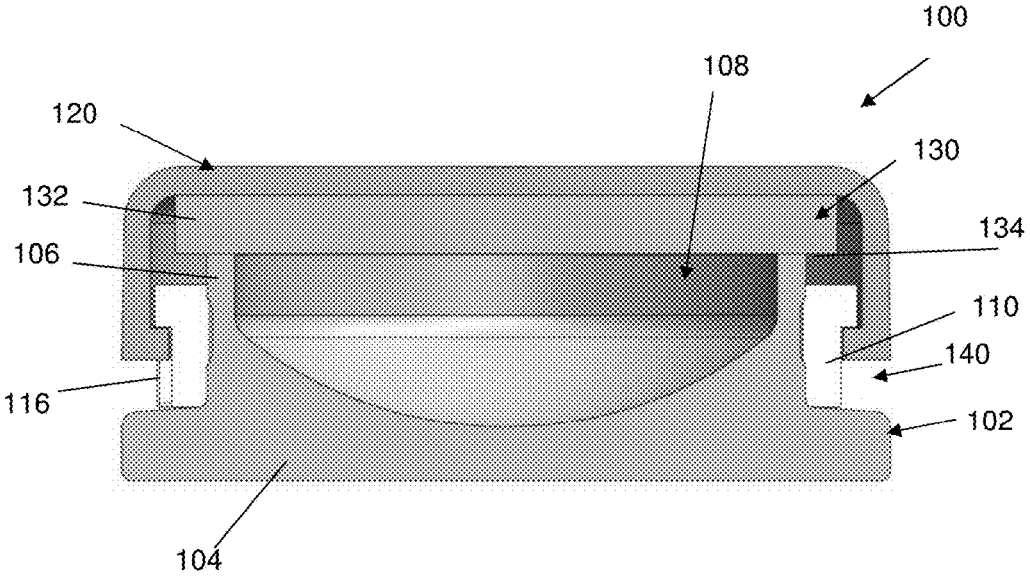
FIG. 1C illustrates a vertical, cross-section view of the container of FIG. 1A.
Figure 1D:
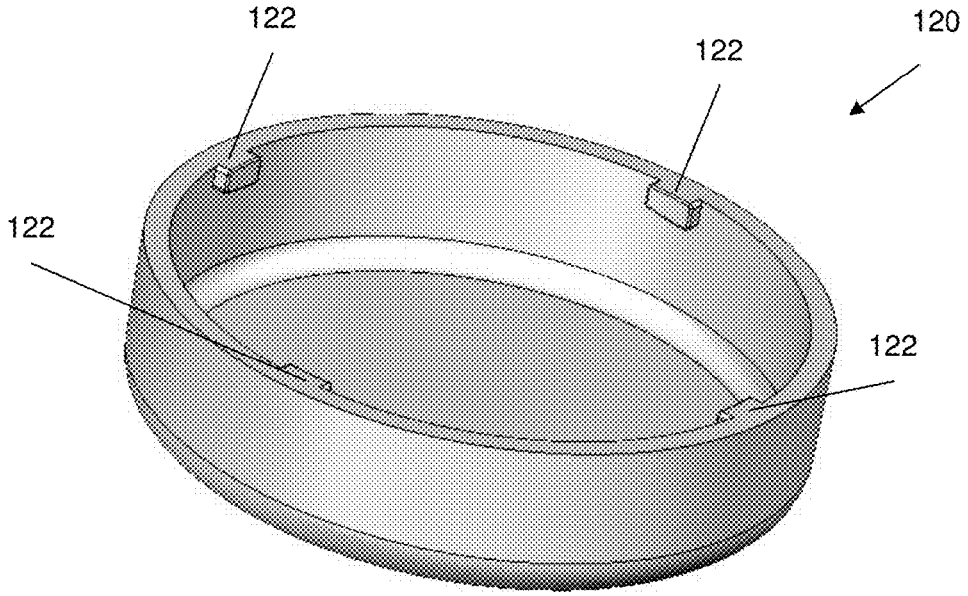
FIG. 1D illustrates a bottom, perspective view of the cap of the container of FIG. 1A.

Container 100 further includes an insert 130 having a first layer 132 of compressible foam onto which a second layer 134 of polytetrafluoroethylene such as Teflon™ can be attached. This dual layer insert 130 acts to create a vapor-tight and liquid-tight seal of the interior portion 108 when pressed against the body 102, such as shown in FIG. 1C. In this manner, the second layer 134 is configured to rest on top of at least one of the band and body, and preferably rest upon a top surface of the sidewall 106.

Thus, when the cap 120 engages with the band 110, the first layer 132 is compressed thereby sealing the interior portion 108 via the second layer 134 held securely in place on the body 102 by the cap 120.

To secure the cap 120 to the band 110, it is contemplated that the band 110 can include a plurality of lugs 116 disposed about an exterior surface of the band 110. Each of the lugs 116 has a first sidewall 117 adjacent to a recess, notch, or other indentation 118. The first sidewall 117 preferably extends from a top surface to a bottom surface of the band 110, such as shown in FIG. 1A. Each lug 116 can also have a second sidewall 119 disposed on an opposite side of the first sidewall 117. Preferably, the second sidewall 119 comprises a straight first edge and a tapered second edge, with the straight first edge of the second sidewall 119 bordering a portion of the recess, notch, or other indentation 118.

The cap 120 can include a plurality of complementary projections 122 each extending inwardly from an inner surface of the cap 120, each of which is configured to be disposed at least in part of the recess, notch, or other indentation 118 of a lug 116. In this manner, each of the projections 122 of the cap 120 can rest within the recess, notch, or other indentation 118 when the cap 120 is engaged with the band 110.

Thus, to secure the cap 120 to the band 110, the plurality of projections 122 should be each inserted into one recess, notch, or other indentation 118 of the plurality of lugs 116. This is accomplished by pushing down on the cap 120 against the body 102, which thereby compresses the first layer 132 of foam of the insert 130 and presses the second layer 134 of the insert 130 against a top surface of sidewall 106 of body 102. The cap 120 is then rotated relative to the body 102 to align the projections 122 with the recesses, notches, or other indentations 118. When the downward force on the cap 120 is released, the projections 122 will rest within the recesses, notches, or other indentations 118.

Once released, the foam creates an upward compression force between the cap 120 and body 102, which pushes the cap 120 up and away from the body 102, and keeps the projections 122 within the recesses, notches, or other indentations 118. It is contemplated that the foam could require an eight pound force to fully compress, although the force could vary depending on the type of foam utilized. The amount of force chosen is preferably sufficient to prevent opening of the container 100 by a small child.

To disengage the cap 120 from the body 102, the opposite must occur. First, a downward force must be applied to the cap 120 to compress the foam of first layer 132 and allow the projections 122 to move past the second sidewall 119. Then, the cap 120 is rotated counterclockwise and released.

It is preferred that a height of the body 102 is greater than a height of the band 110. This is best shown in FIG. 1C. As shown, a top surface of the at least one sidewall 106 extends above a top surface of the band 110, and the second layer 134 of insert 130 can rest upon a top surface of the sidewall 106 of body 102.

It is further contemplated that the base 104 (bottom portion) of the body 102 has a diameter or width that is greater than a diameter or width of a top portion of the body 102 (e.g., sidewall 106). This provides additional stability to the container 100 to help prevent the container 100 from being accidentally overturned. In such embodiments, it is preferred that the cap 120 has a diameter or width that is equal to the diameter or width of base 104, such as shown in FIG. 1B. A space or gap 140 can be formed between base 104 and the cap 120 when the cap 120 is engaged with the band 110.

In one aspect, the band 110 can rest on the base 104 when the band 110 is coupled with the body 102. This can provide further support to the band 110 and lugs 116 when downward force is applied to the cap 120, as base 104 prevents band 110 from moving downward when the force is applied.

In preferred embodiments, the base 104 and at least one sidewall 106 form a cylinder with the first opening at one end. In such embodiments, the band 110 comprises a ring that extends around a portion of the at least one sidewall 106.

Figure 2A:
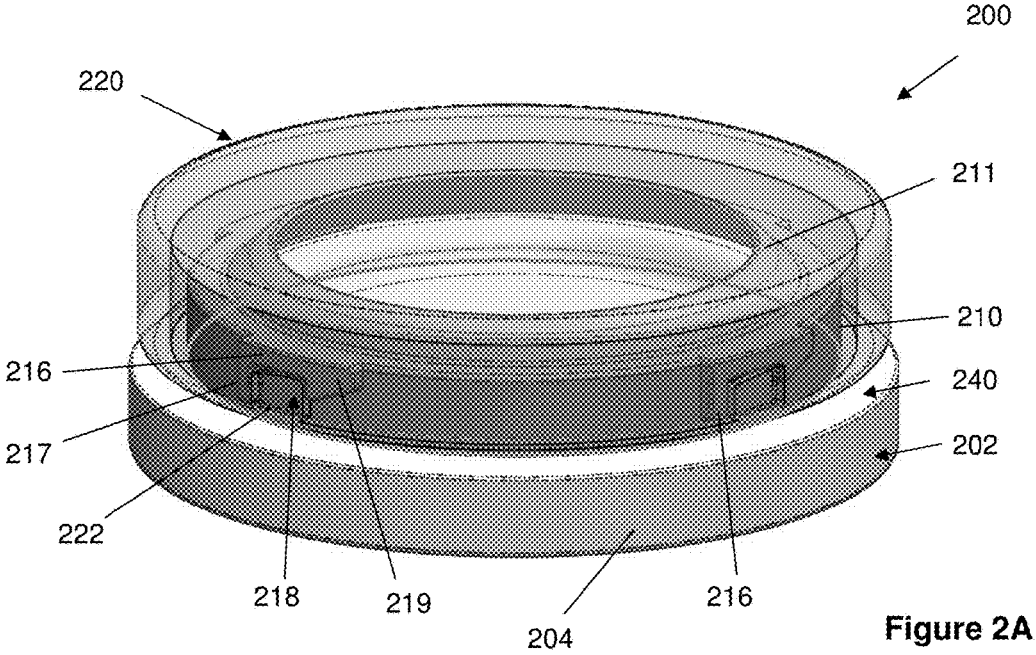
FIG. 2A illustrates a wire-frame view of another embodiment of a container.
Figure 2B:
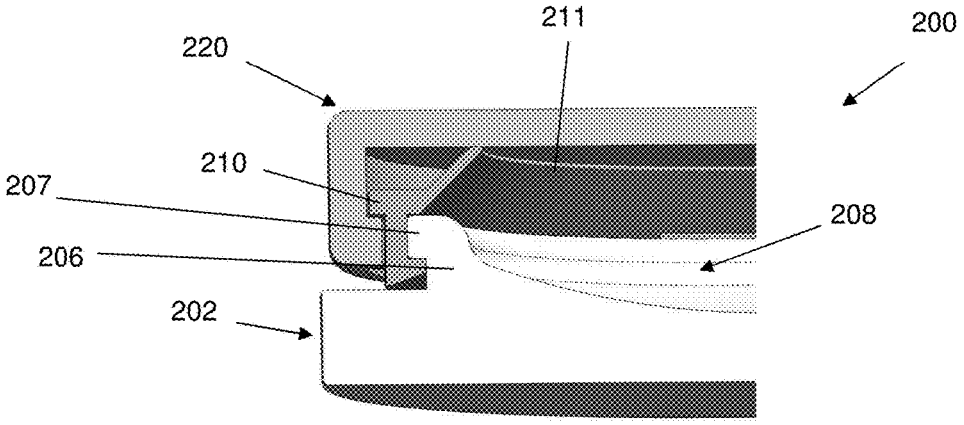
FIG. 2B illustrates a vertical, cross-section view of the container of FIG. 2A.

FIGS. 2A-2B illustrate an alternative embodiment of a container 200 comprising a body 202 having with a base 204 with at least one sidewall 206 extending from the base 204, such that the base 204 and at least one sidewall 206 define an interior portion 208 of the body 202. It is especially preferred that the body 202 is composed of glass to provide a container that can remain liquid-tight and vapor-tight for many months. Glass is also preferred because it is unlikely to affect an odor or flavor of the contents stored within, as opposed to plastic or certain metals. However, it is contemplated that other materials could be used, especially those materials that will provide a liquid-tight and vapor-tight container that will not break down for at least six months.

A flexible band or seal 210 can be attached to the body 202 to provide a mechanism to which a cap 220 can be coupled to the body 202, and that provides the necessary seal to prevent odors and liquid from escaping the container 200. Unlike the container of FIGS. 1A-1D, container 200 lacks a separate insert and utilizes the upper portion 211 of the band 210, which is configured to extend upwardly and inwardly. The upper portion 211 is flexible such that the upper portion 211 will flex downwardly when the cap 220 is placed on top of the upper portion 211, while the upper portion 211 maintains contact with the inner surface of the top of cap 220.

Band 210 is preferably coupled with an exterior surface of the at least one sidewall 206 of the body 202. As shown in FIG. 2B, the band 210 can be fitted around a rim 207 of the at least one sidewall 206, such that the band 210 is secured in place relative to the body 202. Band 210 is preferably composed of rubber or other flexible material that provides a liquid-tight and air-tight seal, and has sufficient resilience to permit the flexing described above.

Cap 220 is configured to engage with the band 210 to thereby cover the first opening and seal the interior portion 208. To secure cap 220 to the band 210, it is contemplated band 210 can include a plurality of lugs 216 disposed about an exterior surface of band 210. Each of the lugs 216 preferably has a first sidewall 217 adjacent to a recess, notch, or other indentation 218. Each lug 216 can also have a second sidewall 219 disposed on an opposite side of the first sidewall 217. Preferably, the second sidewall 219 comprises a straight first edge and a tapered second edge, with the straight first edge of the second sidewall 219 bordering a portion of the recess, notch, or other indentation 218.

Cap 220 can include a plurality of complementary projections 222 each extending inwardly from an inner surface of the cap 220, each of which is configured to be disposed at least in part of the recess, notch, or other indentation 218 of a lug 216. In this manner, each of the projections 222 of the cap 220 can rest within the recess, notch, or other indentation 218 when the cap 220 is engaged with the band 210.

Like the embodiment shown in FIGS. 1A-1D, to secure cap 220 to band 210, the plurality of projections 222 should be each inserted into one recess, notch, or other indentation 218 of the plurality of lugs 216. This is accomplished by pushing down on the cap 220 against the body 202, which thereby flexes the upper portion 211 of the band 210 downwardly. This action creates a seal between the upper portion 211 and the cap 220, as shown in FIG. 2B.

The cap 220 is then rotated relative to the body 202 to align the projections 222 with the recesses, notches, or other indentations 218. When the downward force on the cap 220 is released, the projections 222 will rest within the recesses, notches, or other indentations 218. Once released, the upper portion 211 provides an upward force against the cap 220, which pushes the cap 220 up and away from the body 202, and keeps the projections 222 within the recesses, notches, or other indentations 218. The amount of force provided is preferably sufficient to prevent opening of the container 100 by a small child.

To disengage the cap 220 from the body 202, the opposite must occur. First, a downward force must be applied to the cap 220 to move the projections 222 past the second sidewall 219. Then, the cap 220 is rotated counterclockwise and released.

Base 204 (bottom portion) of the body 202 preferably has a diameter or width that is greater than a diameter or width of a top portion of the body 202 (e.g., sidewall 206). This provides additional stability to the container 200 to help prevent the container 200 from being accidentally overturned. In such embodiments, it is preferred that the cap 220 has a diameter or width that is equal or near equal to the diameter or width of base 204, such as shown in FIG. 2B. A space or gap 240 can be formed between base 204 and the cap 220 when the cap 220 is engaged with the band 210. With respect to the remaining numerals in FIGS. 2A and 2B, the same considerations for like components with like numerals of FIG. 1A apply.

Figure 3A:
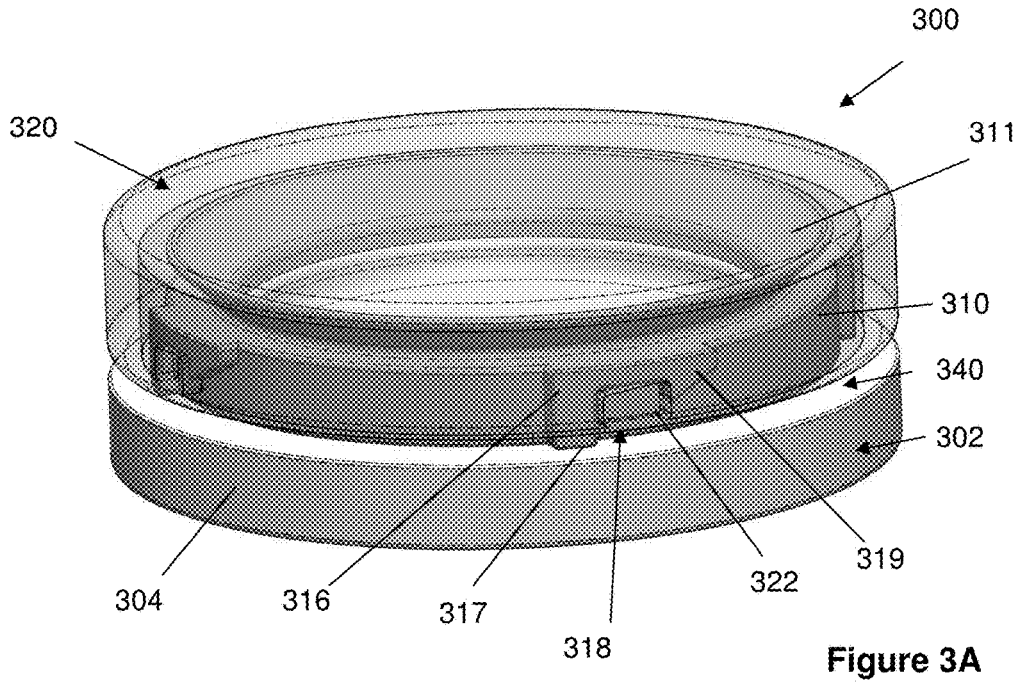
FIG. 3A illustrates a wire-frame view of yet another embodiment of a container.
Figure 3B:
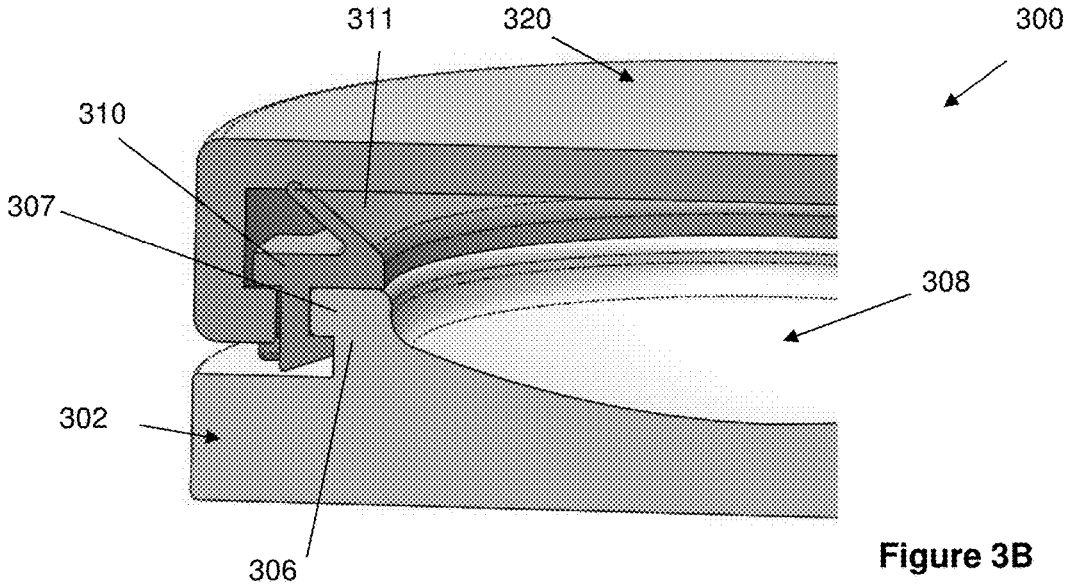
FIG. 3B illustrates a vertical, cross-section view of the container of FIG. 3A.

FIGS. 3A-3B illustrate an alternative embodiment of a container 300 comprising a body 302 having with a base 304 with at least one sidewall 306 extending from the base 304, such that the base 304 and at least one sidewall 306 define an interior portion 308 of the body 302. It is especially preferred that the body 302 is composed of glass to provide a container that can remain liquid-tight and vapor-tight for many months. Glass is also preferred because it is unlikely to affect an odor or flavor of the contents stored within, as opposed to plastic or certain metals. However, it is contemplated that other materials could be used, especially those materials that will provide a liquid-tight and vapor-tight container that will not break down for at least six months.

Similar to that shown in FIGS. 2A-2B, container 300 comprises a flexible band or seal 310 that can be attached to the body 302 to provide a mechanism to which a cap 320 can be coupled to the body 302, and that provides the necessary seal to prevent odors and liquid from escaping the container 300. However, unlike the container of FIGS. 2A-2B, band 310 has an upper portion 311, which is tapered to extend upwardly and outwardly. The upper portion 311 is flexible such that the upper portion 311 will flex downwardly when the cap 320 is placed on top of the upper portion 311.

The band 310 can be attached to the body 302 similarly to that described above. Cap 320 couples to the band 310 in a similar manner to that described with respect to container 200. With respect to the remaining numerals in FIGS. 3A and 3B, the same considerations for like components with like numerals of FIGS. 2A and 2B apply, respectively.

Figure 4:
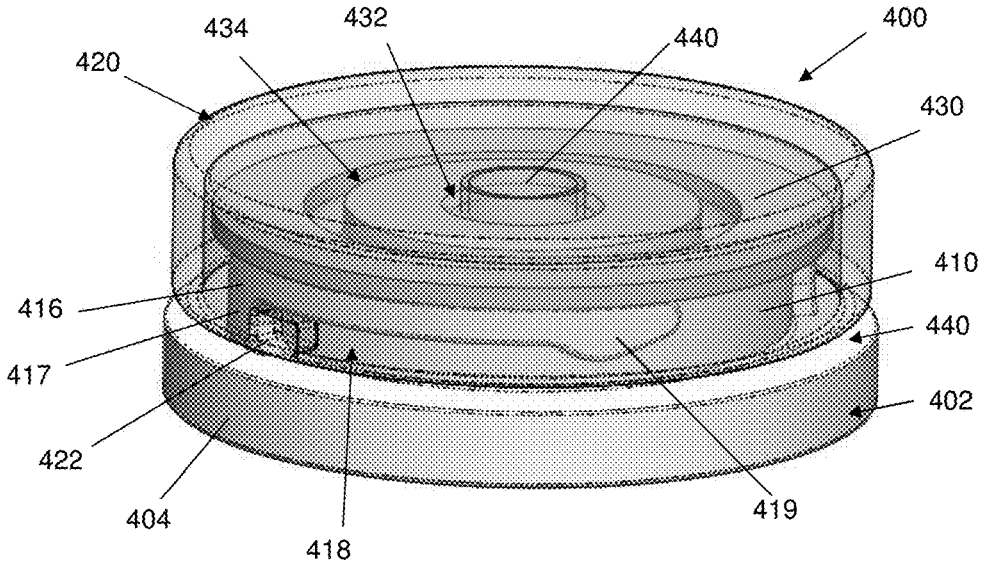
FIG. 4 illustrates a wire-frame view of yet another embodiment of a container.

FIG. 4 illustrates an alternative embodiment of a container 400 comprising a body 402 having with a base 404 with at least one sidewall 406 extending from the base 404, such that the base 404 and at least one sidewall 406 define an interior portion 408 of the body 402. Body 402 preferably is composed of glass for the reasons discussed above; however, it is contemplated that other materials could be used, especially those materials that will provide a liquid-tight and vapor-tight container that will not break down for at least six months.

A band 410 can be attached to the body 402 to provide a mechanism to which a cap 420 can be coupled to the body 402. The band 410 is preferably coupled with an exterior surface of the at least one sidewall 406, such as described above. Band 410 is preferably composed of plastic or other polycarbonate formed via an injection molding process.

Container 400 further includes a rubber insert 430 having a first recess or indentation 434, which increases the flexibility of the insert 430. The insert 430 acts as a ring spring with the cover and spring portion made of rubber. Insert 430 can also include a second recess or indentation 432 in a central portion of the insert 430. It is contemplated that the cap 420 can include a central, downward projection 440, which is sized and dimensioned to be received into the second recess or indentation 432. This can help ensure the insert 430 does not move when cap 420 is engaged. Insert 430 is configured to rest on a top surface of the at least one sidewall 406.

Cap 420 couples to the band 410 in a similar manner to that described with respect to containers 100 and 200. With respect to the remaining numerals in FIG. 4, the same considerations for like components with like numerals of FIG. 1A apply.

Figure 5A:
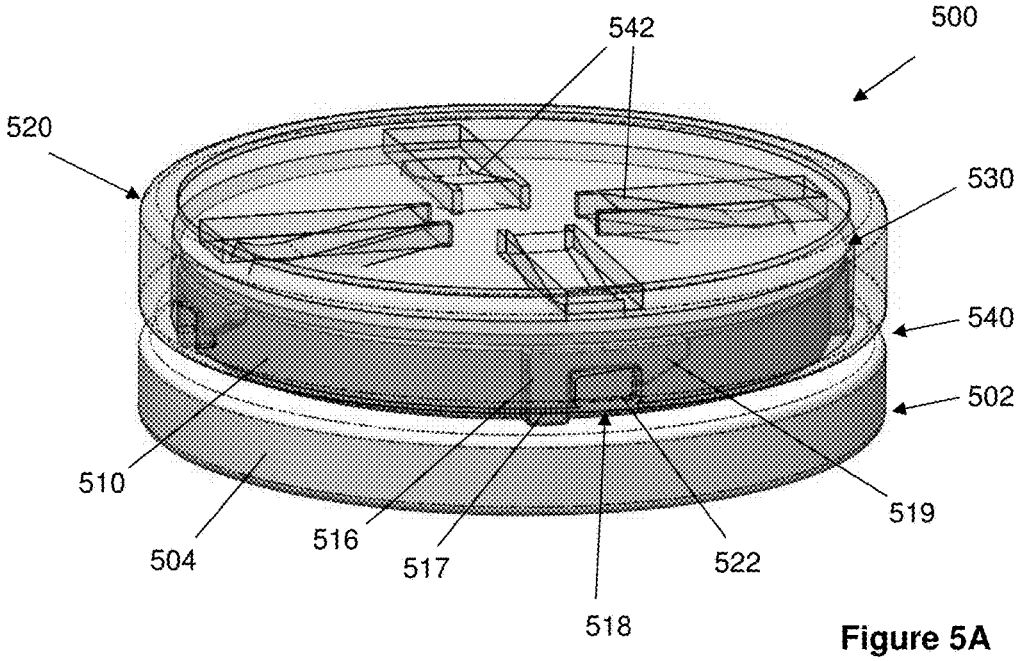
FIG. 5A illustrates a wire-frame view of yet another embodiment of a container.
Figure 5B:
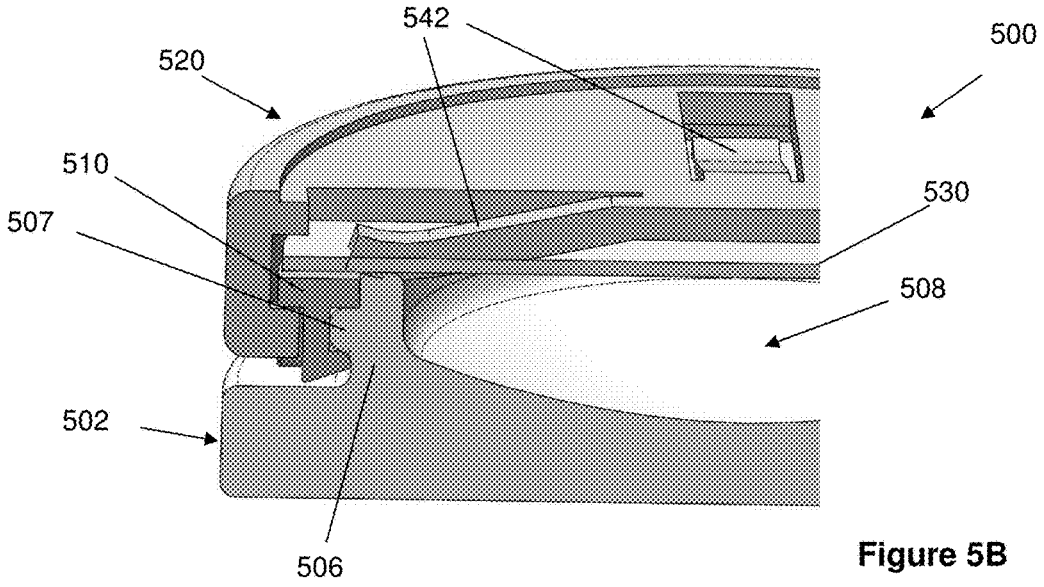
FIG. 5B illustrates a vertical, cross-section view of the container of FIG. 5A.

FIGS. 5A-5B illustrate an alternative embodiment of a container 500 comprising a body 502 having with a base 504 with at least one sidewall 506 extending from the base 504, such that the base 504 and at least one sidewall 506 define an interior portion 508 of the body 502. Body 502 preferably is composed of glass for the reasons discussed above; however, it is contemplated that other materials could be used, especially those materials that will provide a liquid-tight and vapor-tight container that will not break down for at least six months.

A band 510 can be attached to the body 502 to provide a mechanism to which a cap 520 can be coupled to the body 502. The band 510 is preferably coupled with an exterior surface 503 of the at least one sidewall 506 of the body 502, such that the band 510 is secured in place relative to the body 502. It is especially preferred that the band 510 snap-fits onto the body 502. Band 510 is preferably composed of plastic or other polycarbonate formed via an injection molding process. The use of the band 510 to engage with cap 520 advantageously provides a more precise and accurate locking than can be achieved by using glass alone. Cap 520 is configured to engage with the band 510 to thereby cover the first opening and seal the interior portion 508.

Container 500 further includes an insert 530 preferably having a layer of polytetrafluoroethylene such as Teflon™. This insert 530 acts to create a vapor-tight and liquid-tight seal when pressed against the body 502, such as shown in FIG. 5B. In this manner, the second layer 534 is configured to rest on top of a top surface of the sidewall 506.

Cap 520 comprises a set of springs 542 that extend downwardly from an inner surface of the cap 520, such that the springs 542 are configured to contact the insert 530 when the cap 520 engages with the band 510. In this manner, cap 520 acts as a spring board to ensure the insert 530 is held in place tightly against the sidewall 506, so no liquid or odor can escape. If needed for additional compression, insert 530 could include a layer of compressible foam as discussed above.

Cap 520 couples to the band 510 in a similar manner to that described above. With respect to the remaining numerals in FIGS. 5A and 5B, the same considerations for like components with like numerals of FIGS. 1B and 1C apply, respectively.

FIGS. 6A-6D illustrate an alternative embodiment of a container 600 comprising a body 602 having a base 604 and at least one sidewall 606, which collectively define an interior portion 608 of the body 602.

Figure 6A:
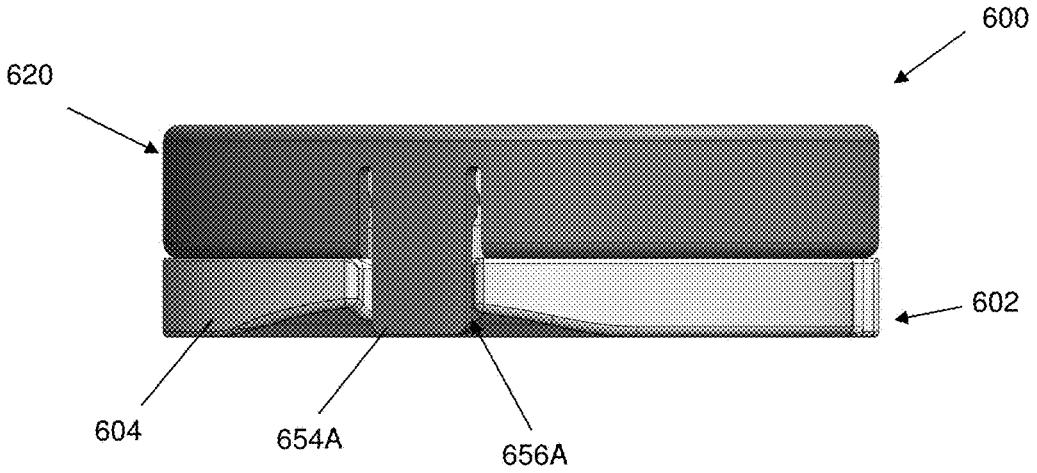
FIG. 6A illustrates a side view of another embodiment of container.

Container 600 further includes an insert 630 that preferably comprises a first layer of compressible foam onto which a second layer of polytetrafluoroethylene such as Teflon™ can be attached. This dual layer insert 630 thereby acts to create a vapor-tight and liquid-tight seal when pressed against the body 602, such as shown in FIG. 6D. In this manner, the second layer is configured to rest on a top surface of the sidewall 606.

Thus, when the cap 620 engages with the body 602, the first layer is compressed thereby sealing the interior portion 608 via the second layer held securely in place on the body 602 by the cap 620.

As shown in FIG. 6D, cap 620 engages with body 602 via complementary helical ridges 650, 652 with a first helical ridge 650 disposed on an inner surface of the cap 620, and a second helical ridge 652 disposed on an outer surface of the body 602. The cap 620 is secured to the body 602 by rotating the cap 620 with respect to the body 602. To release, the cap 620 is rotated in the opposite direction with respect to the body 602.

Cap 620 further comprises at least one tab 654A, which extends downwardly from the cap 620 and is configured to rest within a recessed portion or indentation 656A of the body 602 when the cap 620 is engaged with the body 602. As shown in FIG. 6A, the walls of the recessed portion or indentation 656A prevent side-to-side movement of the tab 654A, unless the tab 654A is first lifted away from the body 602 and then rotated.

Figure 6B:
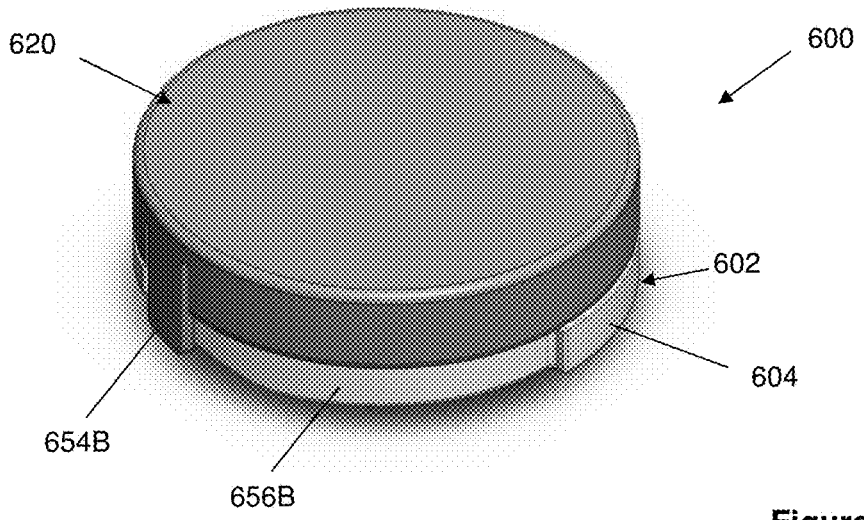
FIG. 6B illustrates a top, perspective view of the container of FIG. 6A.
Figure 6C:
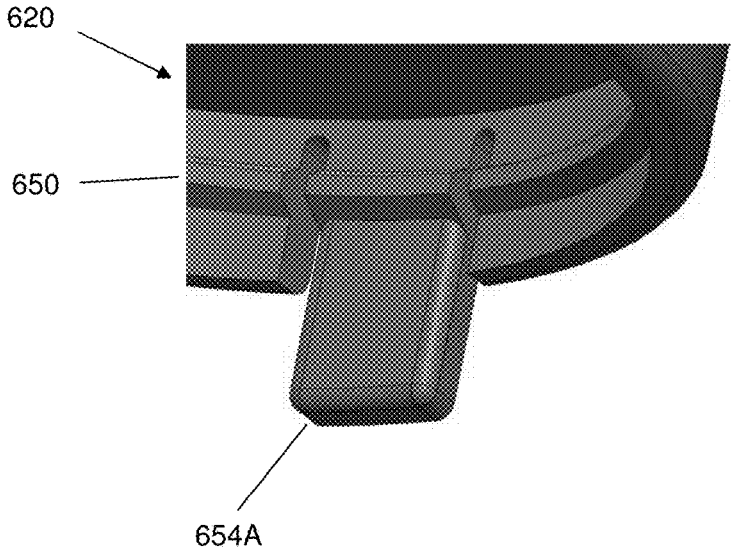
FIG. 6C illustrates a enlarged view of the cap of the container of FIG. 6A.
Figure 6D:
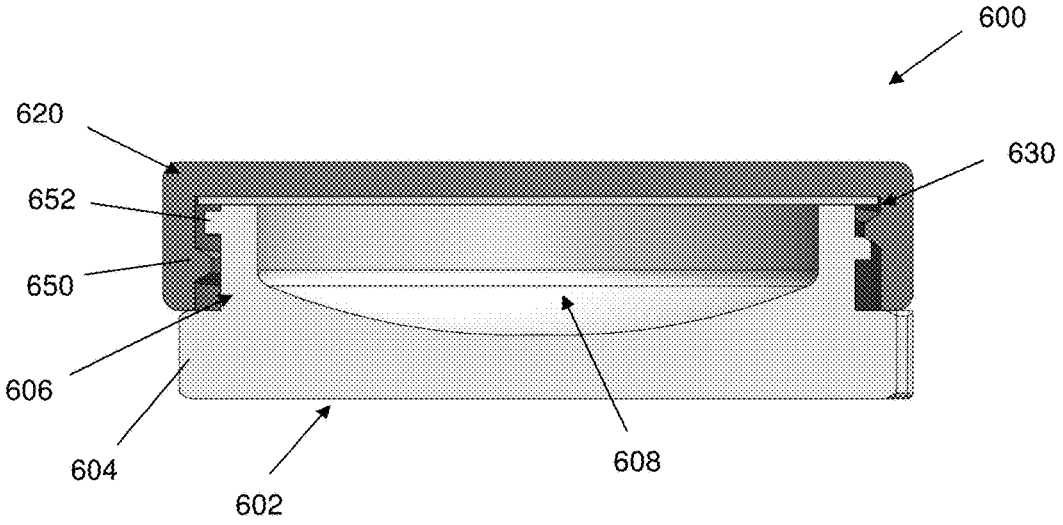
FIG. 6D illustrates a vertical, cross-section view of the container of FIG. 6A.

FIG. 6B illustrates that the cap 620 can include at least two tabs 654A, 654B, with the second tab 654B being disposed in a larger recessed portion 656B of the body 602 than that of the first tab 654A.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A container, comprising:

a body having a base with at least one sidewall extending from the base, such that the base and at least one sidewall define an interior portion of the body with a first opening;

a band configured to be coupled with an exterior surface of the at least one sidewall of the body, such that the band is secured in place to the body, wherein the band further comprises a plurality of lugs disposed about an exterior surface of a first side of the indentation of each lug comprises a first wall that extends from a top to a bottom of the band, and wherein an opposing second side of the indentation comprises a second wall having a straight first edge and a tapered second edge, and wherein the straight first edge borders a portion of the indentation;

an insert comprising a first layer of compressible foam and a second layer of polytetrafluoroethylene, and wherein the second layer is configured to rest on top of at least one of the band and body; and a cap configured to engage with the band to thereby cover the first opening, wherein the cap comprises a plurality of projections that are each configured to rest within one of the indentations of the plurality of lugs when the cap is engaged with the band;

wherein when the cap engages with the band, the first layer is compressed thereby sealing the interior portion via the second layer held in place by the cap.

2. The container of claim 1, wherein the body comprises at least one projection that extends outwardly from an outer surface of the at least one sidewall, and wherein the band comprises an indentation on an inner surface of the band, and wherein the band engages the body when the at least one projection of the body is inserted within the indentation of the band.

3. The container of claim 1, wherein the base and at least one sidewall form a cylinder with the first opening at one end, and wherein the band comprises a ring that extends about a portion of the at least one sidewall.

4. The container of claim 1, wherein a height of the body is greater than a height of the band.

5. The container of claim 4, wherein the band is coupled to the body such that a top surface of the body extends above a top surface of the band, and wherein the second layer of the insert rests on the top surface of the body.

6. The container of claim 1, wherein the body is composed of glass, and the band comprises plastic.

7. The container of claim 1, wherein the body comprises a bottom portion having a diameter or width that is greater than a diameter or width of a top portion of the body.

8. The container of claim 7, wherein the cap and bottom portion of the body has an equal diameter or width.

9. The container of claim 7, wherein a space or gap is formed between the bottom portion of the body and the cap when the cap is engaged with the band.

10. The container of claim 7, wherein the band rests on the bottom portion of the body when the band is coupled with the body.

11. The container of claim 1, wherein the cap comprises a set of springs that extend downwardly from an inner surface of the cap, and wherein the springs are configured to contact the insert when the cap engages with the band.

12. An air-tight container, comprising:

a glass body having a base with a first sidewall extending upwardly from the base, such that the base and first sidewall define an interior portion of the body;

a ring configured to snap onto an exterior surface of the first sidewall to secure the ring in place to the body;

an insert comprising a first layer of compressible foam and a second layer of polytetrafluoroethylene, and wherein the second layer is configured to rest on a top surface of the first sidewall;

a cap configured to engage with the band to thereby close the interior portion;

wherein the ring comprises a set of lugs disposed about an exterior surface of the ring, wherein each of the set of lugs comprises an indentation, wherein a first side of the indentation of each lug comprises a first wall that extends from a top to a bottom of the ring, and wherein an opposing second side of the indentation comprises a second wall having a straight first edge and a tapered second edge and wherein the straight first edge borders a portion of the indentation, and wherein the cap comprises a plurality of projections disposed on an interior surface of the cap, wherein each of the projections is configured to engage with one of the lugs and rest within the indentation of the lug when the cap is engaged with the ring; and wherein when the cap engages with the band, the first layer is compressed exerting force on the second layer and thereby sealing the interior portion.

13. The container of claim 12, wherein the body comprises first and second projections that each extends outwardly from an outer surface of the first sidewall, and wherein the ring comprises at least one indentation on an inner surface of the ring, and wherein the ring snaps onto the body when the first and second projections are engaged with at least one indentation.

14. The container of claim 12, wherein a height of the body is greater than a height of the ring, and wherein a top surface of the body extends above a top surface of the ring when the ring is snapped onto the body.

15. The container of claim 12, wherein the body comprises a bottom portion having a diameter or width that is greater than a diameter or width of a top portion of the body, and wherein the cap and bottom portion of the body has an equal diameter or width.

16. The container of claim 12, wherein a space or gap is formed between the bottom portion of the body and the cap when the cap is engaged with the band.

* * * * *